United States Patent [19]

Rogers, Jr. et al.

[11] Patent Number: 4,655,450

[45] Date of Patent: Apr. 7, 1987

[54] HEAD GRIPPING APPARATUS FOR A NECK EXERCISING MACHINE

[76] Inventors: Burton L. Rogers, Jr., 541 Caswell Ave., Toledo, Ohio 42609; Leonard O. Greninger, 7062 Altara Dr., Sylvania, Ohio 43560

[21] Appl. No.: 639,721

[22] Filed: Aug. 13, 1984

[51] Int. Cl.[4] ..... A63B 23/00

[52] U.S. Cl. ..... 272/94; 272/126; 272/DIG. 4

[58] Field of Search ..... 272/94, 93, 95, 119, 272/120, 121, 126, 134, 143, DIG. 4; 128/76 R, 76 B, 76 C, 76 D, 69, 68, 25 R, 97; 33/143 C, 191; 273/183 B, 190 R, 190 A, 190 C

[56] References Cited

U.S. PATENT DOCUMENTS

| | | | |
|---|---|---|---|
| 578,196 | 3/1897 | Beck | 33/191 |
| 1,398,871 | 11/1921 | Livingston | 33/191 |
| 1,487,998 | 3/1924 | Woolf | 128/791 |
| 2,727,510 | 12/1955 | Thompson | 128/69 |
| 2,791,999 | 5/1957 | Bustamante | 272/94 X |
| 2,855,202 | 10/1958 | Kinne | 272/94 |
| 2,882,892 | 4/1959 | Kosior . | |
| 3,709,216 | 1/1973 | Hilyard | 128/69 |
| 4,066,259 | 1/1978 | Brentham | 272/94 |
| 4,189,141 | 2/1980 | Rooney . | |
| 4,219,193 | 8/1980 | Newman . | |
| 4,278,249 | 7/1981 | Forrest . | |
| 4,339,124 | 7/1982 | Vogler . | |
| 4,357,011 | 11/1982 | Voris . | |

OTHER PUBLICATIONS

Nautilus Rotary Neck Machine, Athletic Journal 1975, p. 7.

"The Super Neck Developer" advertisement in Coach & Athlete, Jan./Feb. 1979.

"Rotary Neck Machine" Nautilus Instruction Manual, 1979.

*The Nautilus Book* by Ellington Darden, published by Contemporary Books, Inc., Copyrighted 1980 (p. 121).

*Primary Examiner*—Robert A. Hafer

*Assistant Examiner*—Arnold W. Kramer

*Attorney, Agent, or Firm*—Willian, Brinks, Olds, Hofer, Gilson & Lione

[57] ABSTRACT

An apparatus for gripping a human head for use in a neck musculature exercising machine is disclosed. The apparatus includes a pair of side pads adapted to engage the opposing sides of a human head near the ear portions thereof. The side pads are mounted on respective movable cross members, each of which includes a toothed side portion. A control arm is provided for rotating a gear which is engaged on opposite sides thereof with both of the toothed portions of the cross members. Rotation of the control arm causes the cross members and the side pads to be moved simultaneously by equal distances in opposite directions, either both inwardly toward the head or outwardly away from the head. A locking mechanism is provided to maintain the control arm and side pads in a desired position. Chin pads may also be provided in order to more securely grip the enclosed head. Threaded fasteners can be provided to individually adjust any of the side pads or the chin pads to accommodate all shapes and sizes of the enclosed head. The apparatus is connected to a rotatable arm of the neck musculature exercising machine.

27 Claims, 5 Drawing Figures

HEAD GRIPPING APPARATUS FOR A NECK EXERCISING MACHINE

BACKGROUND OF THE INVENTION

1. Field of the Invention

The present invention relates in general to neck exercising devices and in particular to an apparatus for gripping a human head for use in a neck musculature development and evaluation machine.

Few anatomical regions in the body are immune to injury resulting from participation in sports activities. Modern athletes, especially those who play football, are larger, faster, and stronger than those in years past. These physical advancements have been accompanied by improved equipment in an attempt to reduce the likelihood and severity of injury. The biggest advancement in football equipment appears to be in the helmet. Realizing this, athletes have frequently utilized the football helmet as a battering ram. While head injuries are rare because of the improved helmets, the tremendous forces generated in such collisions are likely to cause injury to other parts of the body, particularly the cervical vertebrae of the neck.

It has generally been recognized that the neck musculature of an athlete can be developed through exercise so as to reduce the chance of injury. Additionally, neck exercises may be prescribed for rehabilitation following injury. In either case, it is considered important to exercise all of the neck musculature, including not only those muscles which provide for flexion and extension of the head forward, backward, and laterally, but also those muscles which provide for rotational movement of the head. To exercise the neck musculature which provides for simple flexion and extension, the head is disposed adjacent a movable flat padded surface of an exercising machine. The neck musculature is exercised by pressing the head against the padded surface so as to move through a limited distance, often under a predetermined amount of mechanical resistance generated by the machine. However, to exercise the neck musculature which provides for rotational movement, it is necessary to provide some means for firmly gripping the head about its axis of rotation, as defined by the cervical vertebrae of the neck, so as to provide a secure connection to the exercising machine. Unfortunately, no apparatus is known for firmly gripping heads of varying shapes and sizes which insures such axial alignment, while still providing a reasonable amount of comfort to the wearer.

2. Description of the Prior Art

U.S. Pat. No. 4,278,249 to Forrest discloses a neck exercising device which is capable of facilitating a complete neck exercise through frictionally-resisted pivotal movement on two axes. The neck exercising device is free-standing, and adjustable to trainees of different height, head sizes, and strength. The device permits neck exercise either through resisted pivotal movement on a horizontal first pivot axis effected, for example, by either side-to-side or front-to-back head motion depending upon the orientation of the trainee, through resisted pivotal movement effected by head twisting motion, or both.

Other neck exercising devices are disclosed in U.S. Pat. No. 2,855,202 to Kinne, U.S. Pat. No. 2,882,892, to Kosior, U.S. Pat. No. 4,066,259 to Brentham, U.S. Pat. No. 4,189,141 to Rooney, U.S. Pat. No. 4,219,193 to Newman, U.S. Pat. No. 4,339,124 to Vogler, and U.S. Pat. No. 4,357,011 to Voris.

SUMMARY OF THE INVENTION

The present invention relates to an apparatus for gripping a human head for use in a neck musculature exercising machine. The apparatus includes a pair of side pads adapted to engage the opposing sides of a human head near the ear portions thereof. The side pads are mounted on respective movable cross members, each of which includes a toothed side portion. A control arm is provided for rotating a gear which is engaged on opposite sides thereof with both of the toothed portions of the cross members. Rotation of the control arm causes the cross members and the side pads to be moved simultaneously by equal distances in opposite directions, either both inwardly toward the head or outwardly away from the head. A locking mechanism is provided to maintain the control arm and side pads in a desired position. Chin pads may also be provided in order to more securely grip the enclosed head. Threaded fasteners can be provided to individually adjust any of the side pads or the chin pads to accommodate all shapes and sizes of the enclosed head. The apparatus is connected to a rotatable arm of the neck musculature exercising machine.

It is an object of the present invention to provide an apparatus for gripping a human head for use in a neck musculature development or evaluation machine.

It is a further object of the present invention to provide such a head-gripping apparatus which can be adjusted quickly and easily to heads of varying size and shape.

It is a further object of the present invention to provide such a head-gripping apparatus which automatically aligns the axis of rotation of the head and neck with the axis of rotation of the exercising machine.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
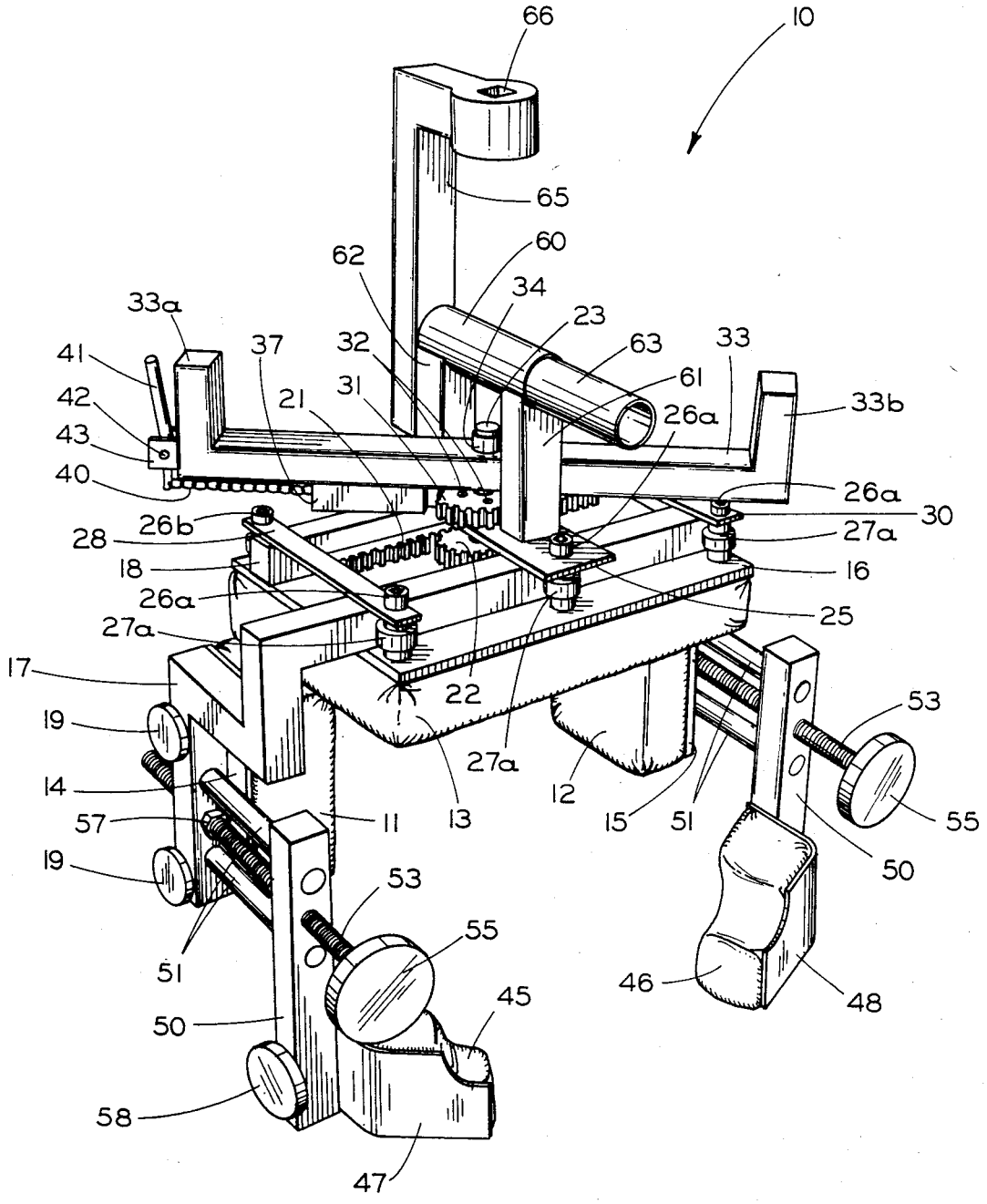
FIG. 1 is a perspective view of an apparatus for gripping a human head in accordance with the present invention.

Referring now to the drawings, there is illustrated an apparatus 10 for gripping a human head in accordance with the present invention. The apparatus 10 includes a pair of side pads 11 and 12 for engaging the opposing sides of a human head (not shown) near the ear portions thereof. The side pads 11 and 12 can each be formed of a relatively hard and inflexible block of material, such as wood, surrounded by a layer of padding material, such as foam, and covered by a suitable enclosure material, such as vinyl plastic. When the side pads 11 and 12 are moved against the opposing sides of a human head, they provide a secure and relatively comfortable engagement thereof. A top pad 13 formed of the same materials can be provided to abut the top portion of the human head. Each of the side pads 11 and 12 is attached to a respective metallic backing plate 14 and 15 on the side thereof opposed to the side adapted to engage the head. The top pad 13 is similarly attached to a metallic backing plate 16.

Figure 2:
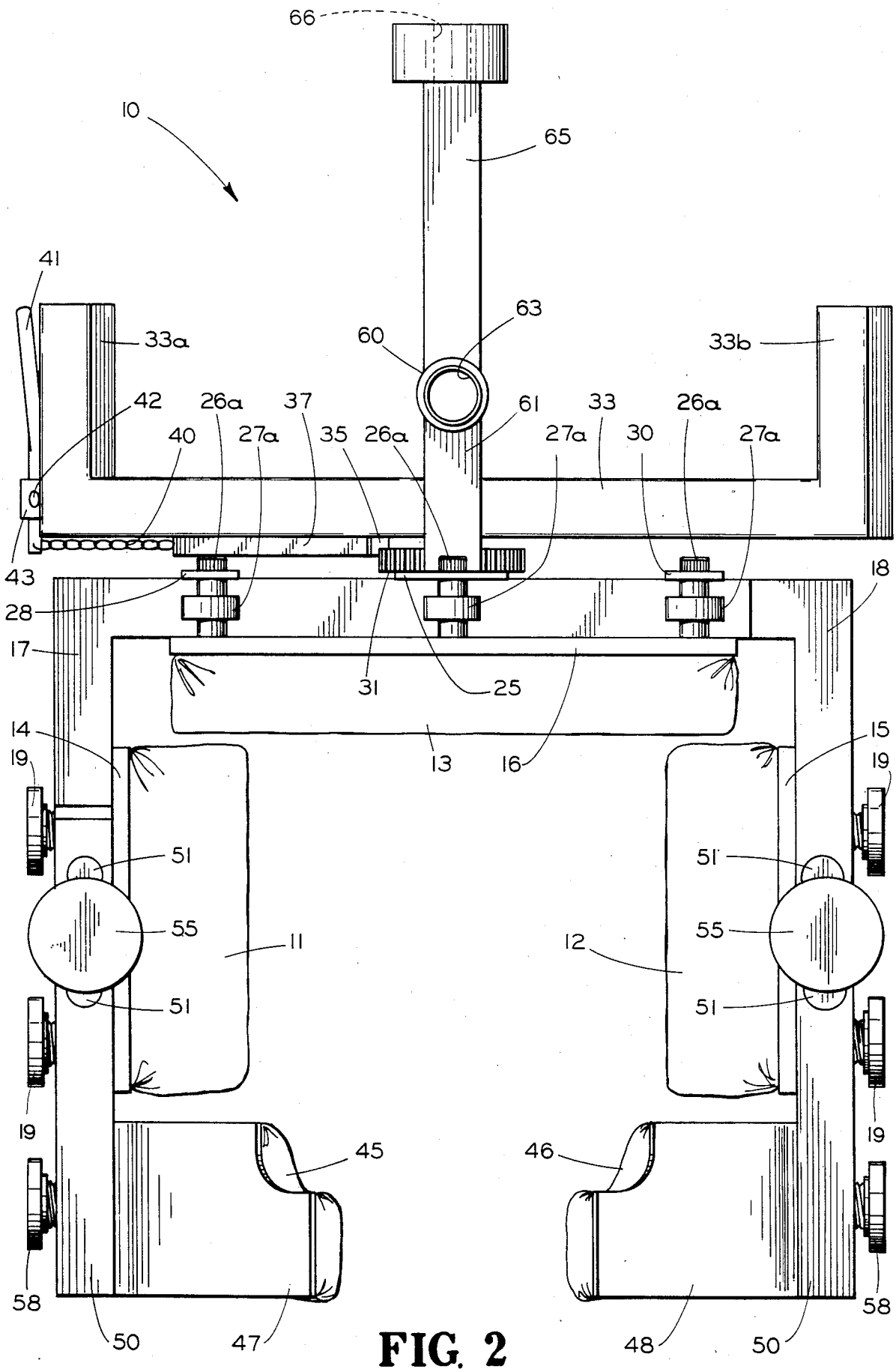
FIG. 2 is a front elevational view of the head-gripping apparatus of FIG. 1.

The apparatus 10 is provided with means for moving the side pads 11 and 12 laterally, i.e., left and right as viewed in FIG. 2, simultaneously in opposite directions and by equal distances so as to engage an enclosed head. In order to accomplish this, the side pads 11 and 12 are attached to respective cross members 17 and 18. The cross members 17 and 18 are each adapted for sliding movement laterally across the top surface of the top pad backing plate 16. The front cross member 17 is formed with several bends in order to extend downwardly and rearwardly to the one side pad 11, while the rearward cross member 18 is provided with a single bend extending downwardly therefrom to extend to the other side pad 12. If desired, an adjusting means, such as a pair of threaded fasteners 19, can be provided to slightly tilt the upper or lower ends of either of the side pads 11 and 12 to more closely conform to the shape of the enclosed head.

Figure 4:
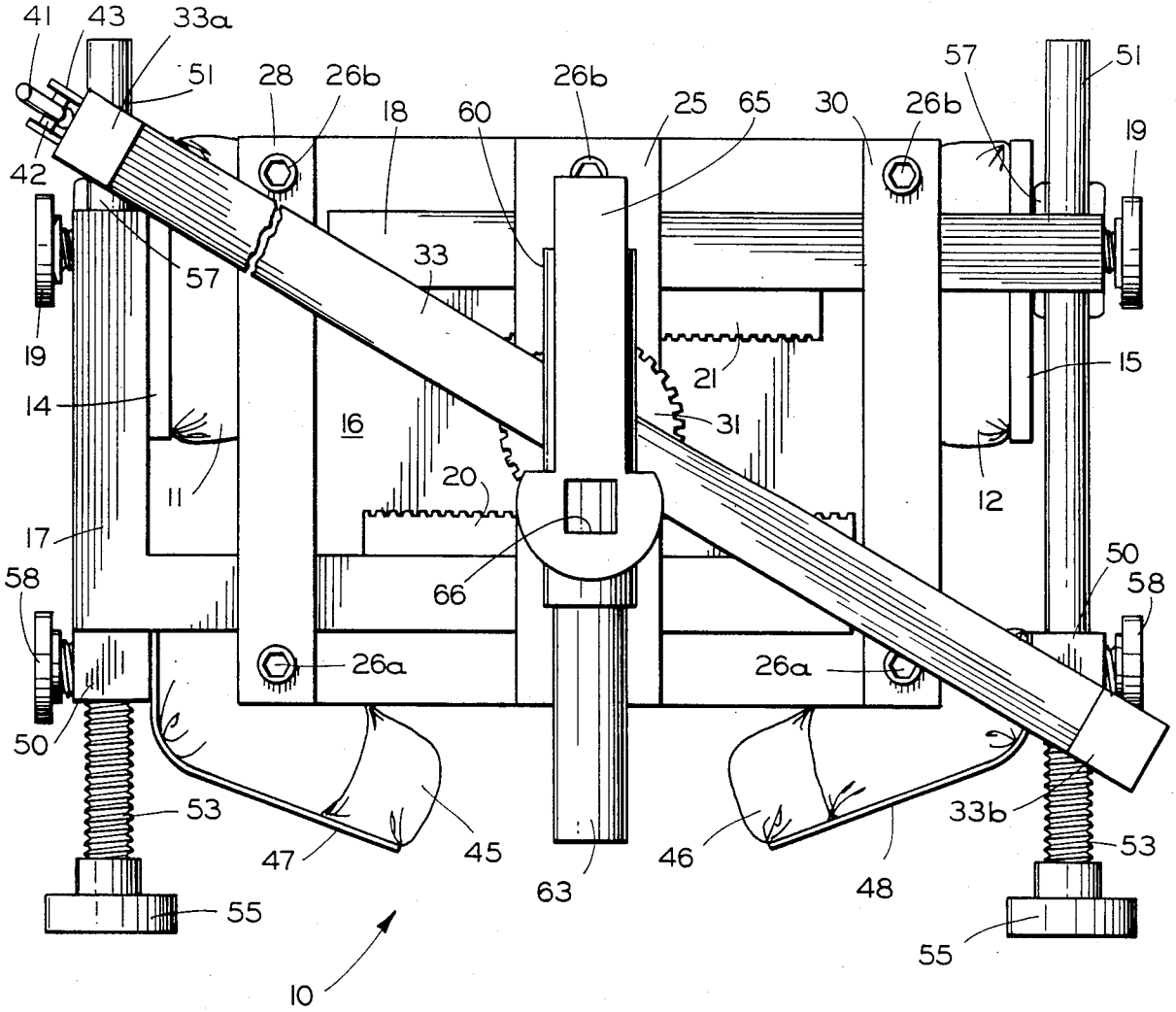
FIG. 4 is a top plan view of the head-gripping apparatus of FIG. 1.

As shown most clearly in FIG. 4, the front and rear cross members 17 and 18 have respective linear toothed portions 20 and 21 formed thereon or otherwise secured thereto. The toothed portions 20 and 21 simultaneously engage the opposing toothed sides of a lower gear 22. The lower gear 22 is keyed or otherwise secured to a vertical shaft 23 for rotation therewith. The vertical shaft 23 is journalled for rotation at its lower end in an aperture (not shown) formed in the top pad backing plate 16 and near its upper end in an aperture (not shown) formed in a central strut 25. A pair of threaded fasteners 26*a* and 26*b* extend through respective apertures (not shown) formed in the ends of the central strut 25 and through respective spacer elements 27*a* and 27*b* into threaded engagement with the top pad backing plate 16. First and second side struts 28 and 30, respectively, are also secured to the top pad backing plate 16 on opposite sides of the central strut 25 by similar threaded fasteners 26*a* and 26*b* and spacer elements 27*a* and 27*b*. The threaded fasteners 26*a* and 26*b* are utilized to secure each of the struts 25, 28, and 30 to the top pad backing plate 16, while the spacer elements 27*a* and 27*b* are provided to maintain a predetermined spaced apart relationship therebetween. This spaced apart relationship is typically only slightly larger than the height of the cross members 17 and 18 so as to provide limited spaces through which the cross members 17 and 18 are guided as they are moved laterally across the top surface of the top pad backing plate 16. Such a guiding means prevents the cross members 17 and 18 from twisting or otherwise moving up or down during movement. In the same manner, the spacer elements 27*a* on the front side of the apparatus 10 and the spacer elements 27*b* on the rear side of the apparatus 10 each respectively cooperate with the lower gear 22 so as to provide similar limited spaces to prevent the front and rear cross members 17 and 18, respectively, from wobbling from front to back.

An upper gear 31 is secured to the central strut 25 by several threaded fasteners 32. The vertical shaft 23 extends through an aperture (not shown) formed in the upper gear 31, but is not keyed or otherwise connected thereto. Thus, the vertical shaft 23 is able to rotate relative to the upper gear 31, as well as the central strut 25. A control arm 33 having upstanding end portions 33*a* and 33*b* is also provided with an aperture (not shown) through which the vertical shaft 23 extends. However, the control arm 33 is keyed or otherwise secured to the vertical shaft 23 for rotation therewith. Thus, rotation of the control arm 33 causes rotation of the vertical shaft 23 and the lower gear 22, but does not cause rotation of the upper gear 31. Since the teeth of the lower gear 22 are engaged with toothed portions 20 and 21 attached to the cross members 17 and 18, respectively, it will be appreciated that rotation of the control arm 33 also causes the above-described lateral transverse movement of the cross members 17 and 18 and the side pads 11 and 12. When viewed from above the apparatus 10, as shown in FIG. 4, the cross members 17 and 18 and their respective side pads 11 and 12 will be moved inwardly toward the center of the apparatus 10 and about an enclosed head when the control arm 33 is rotated in a counter-clockwise direction. Since the gear ratios between the lower gear 22 and each of the toothed portions 20 and 21 are equal, it can be seen that the cross members 17 and 18 will be moved inwardly or outwardly by equal distances when the control arm 33 is rotated. Conversely, the cross members 17 and 18 and their respective side pads 11 and 12 will be moved outwardly from the center of the apparatus 10 and away from an enclosed head when the control arm 33 is rotated in the clockwise direction. A cap 34 is secured to the vertical shaft 23, such as by a threaded fastener 34*a*, so as to prevent the control arm 33 from being lifted off during use.

Figure 5:
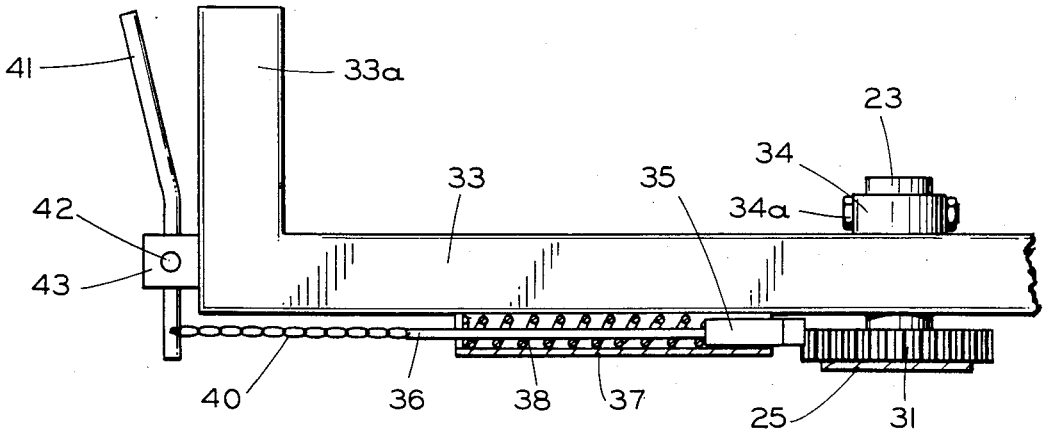
FIG. 5 is a close-up elevational view, partially broken away, of a control arm locking structure of the head-gripping apparatus of FIG. 1.

Means are provided for locking the control arm 33 in a desired position relative to the apparatus 10 so as to maintain the side pads 11 and 12 at a predetermined spaced apart distance. As shown most clearly in FIG. 5, a locking pin 35 is attached to one end of an elongate shaft 36. The locking pin 35 and shaft 36 are slidably disposed within a protective enclosure 37 attached to the bottom side of the control arm 33. A spring 38 (FIG. 5) is disposed about the shaft 36 within the enclosure 37 so as to urge the locking pin 35 outwardly therefrom into engagement with the teeth of the upper gear 31. As explained above, the upper gear 31 is attached to the central strut 25 and cannot be rotated relative thereto. Thus, when the locking pin 35 is extended outwardly into engagement with the teeth of the upper gear 31, the control arm 33 is locked in position with respect to the upper gear 31 and the side pads 11 and 12 are maintained at a predetermined spaced apart distance.

In order to permit the control arm 33 to be rotated relative to the apparatus 10 (and, accordingly, to change the distance by which the side pads 11 and 12 are spaced apart), means are provided for releasing the above-described locking means. In the illustrated embodiment, a chain 40 or other means is connected between the other end of the shaft 36 and a lower end of a trigger arm 41. The central portion of the trigger arm 41 is pivotally secured near the center thereof to the one standing end portion 33*a* of the control arm 33 by a pivot pin 42 mounted in a housing 43. When the upper end of the trigger arm 41 is moved toward the upstanding end portion 33*a* of the control arm 33 by the application of pressure thereto, the lower end of the trigger arm 41 is moved in the opposite direction away from the upstanding end portion 33*a* by virtue of the pivoting action. The chain 40, the shaft 36, and the locking pin 35 are similarly moved in the opposite direction against the urging of the spring 38. When the locking pin 35 has moved a sufficient distance, it will be disengaged from the teeth of the upper gear 31, thus allowing the control arm 33 to be rotated to another desired position. When a newly desired position has been reached, the pressure applied to the upper end of the trigger arm 41 is released. The spring 38 urges the locking pin 35 back into engagement with the teeth of the upper gear 31 so as to lock the control arm 33 in such position.

Figure 3:
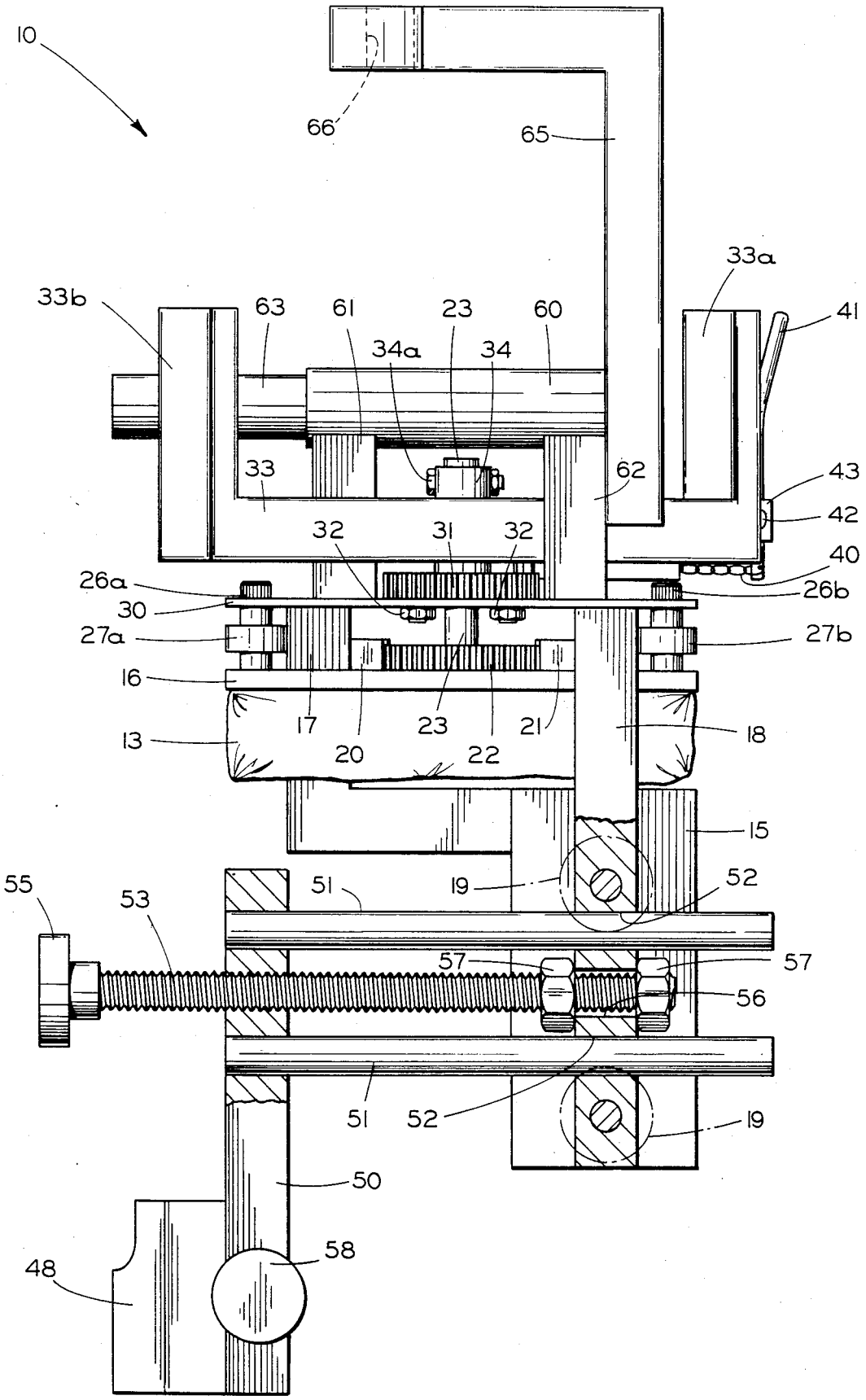
FIG. 3 is a side elevational view of the head-gripping apparatus of FIG. 1.

In order to more firmly and reliably grip a head within the apparatus 10, a pair of chin pads 45 and 46 are provided to engage the opposing sides of the chin of the head. The chin pads 45 and 46 are provided with respective metallic backing plates 47 and 48. The backing plates 47 and 48 are each attached to an upstanding mounting bracket 50. Each of the mounting brackets 50 is provided with a pair of cylindrical mounting shafts 51 affixed thereto. Each of the cylindrical shafts 51 extends rearwardly through respective apertures 52 (FIG. 3) formed in the downwardly-extending portions of the front and rear cross members 17 and 18, respectively. The cylindrical shafts 51 are slidably movable through each of the apertures 52. The apertures 52 permit the shafts 51, the mounting brackets 50, and the chin pads 45 and 46 to be moved frontwardly or rearwardly (i.e., from left to right as viewed in FIG. 3) with respect to the cross members 17 and 18 and, consequently, with respect to the side pads 11 and 12. Accordingly, the apparatus 10 of the present invention provides a secure custom fit for heads of varying sizes.

Means are provided for positioning the chin pads 45 and 46 frontwardly or rearwardly relative to the side pads 11 and 12. As shown most clearly in FIG. 3, a threaded member 53 is threaded through each of the upstanding mounting brackets 50. Each of the threaded members 53 includes an enlarged head portion 55 at one end thereof to permit easy manipulation thereof. The other end of each of the threaded members 53 extends rearwardly through an aperture 56 (FIG. 3) formed in the downwardly-extending portion of the respective cross members 17 and 18. A pair of nuts 57 are threaded onto the threaded member 53 on opposite sides of the respective cross members 17 and 18. When the nuts 57 are tightened against the opposed sides of the respective cross members 17 and 18, the threaded member 53 (and, therefore, the associated mounting bracket 50 and chin pad 45 or 46) will be locked in position relative thereto. By loosening the nuts 57 and rotating them on the threaded member 53, the position of the chin pads 45 and 46 can be adjusted frontwardly or rearwardly relative to the side pads 11 and 12, respectively. Since the chin pads 45 and 46 and their associated mounting hardware are all attached to the cross members 17 and 18, respectively, it will be appreciated that the chin pads 45 and 46 are moved laterally toward and apart from one another as the side pads 11 and 12 are so moved, as described above. If desired, an adjusting means, such as a threaded fastener 58, can be provided to slightly move either of the chin pads 45 or 46 inwardly or outwardly in order to more closely conform to the shape of the enclosed head.

Means are provided for connecting the apparatus 10 to a neck exercising machine (not shown). In the illustrated embodiment, a hollow cylindrical housing 60 is secured above the apparatus 10 by a pair of upstanding support members 61 and 62 attached to the top surface of the central strut 25. The cylindrical housing 60 is adapted to receive a cylindrical extension 63 of a connector arm 65. The connector arm 65 is generally shaped in the form of an inverted L and has a square-shaped aperture 66 formed in the upper end thereof. The aperture 66 is adapted to receive a mating rotatable output arm (not shown) of the neck exercising machine. The neck exercising machine is conventional in the art and provides for limited rotational movement of the output arm, typically under a variable amount of mechanical resistance. The apparatus 10 is utilized in conjunction with the neck exercising machine in order to develop or evaluate the musculature of the neck which provides for rotational movement of the head.

In operation, the apparatus 10 is initially secured to the output arm of the neck exercising machine by any conventional means. The head of a person desiring to utilize the machine is then inserted between the spaced apart side pads 11 and 12. The trigger arm 41 is then moved toward the upstanding end portion 33*a* of the control arm 33 so as to remove the locking pin 35 from engagement with the teeth of the upper gear 31. The control arm 33 is then rotated in a counter-clockwise direction to move the side pads 11 and 12 firmly against the opposing sides of the head. When a comfortable and secure grip of the head has been obtained, the locking pin 41 is released to lock the control arm 33 in position and, therefore, maintain the side pads 11 and 12 in firm contact with the head. If necessary, the angle of the side pads 11 and 12 can be adjusted by manipulation of the threaded members 19. The chin pads 45 and 46 are then moved into firm engagement with the opposing sides of the chin of the enclosed head by operation of the threaded members 53 and the threaded nuts 57. Thus, the enclosed head is securely and comfortably gripped by the apparatus 10.

By utilizing the apparatus 10 in the above-described manner, the axis of rotation of the enclosed head will be automatically aligned about a plane extending from front to rear with the axis of rotation of the output arm of the neck exercising machine (as defined by the square aperture 66). If the axis of rotation of the head does not coincide with the axis of rotation of the machine about a plane extending from side to side, the apparatus 10 can be adjusted by sliding the apparatus 10 along the extension 63 until they do coincide. One or more threaded fasteners (not shown) can be provided to maintain the extension 63 in a desired relative to the housing 60.

In accordance with the provisions of the patent statutes, the principle and mode of operation of the present invention have been explained and illustrated in its preferred embodiment. However, it must be appreciated that the present invention can be practiced otherwise than as specifically explained and illustrated without departing from its spirit or scope.

What is claimed is:

1. An apparatus for gripping a head for use, for example, with a neck exercising machine comprising:

a pair of opposed side pads adapted to be selectively moved inwardly toward one another to engage the opposing sides of the head;

a chin pad carried by each of said side pads and movable inwardly therewith for engaging the opposing sides of the chin of the head;

positioning means connected between each of said side pads and said respective chin pad carried thereby for selectively moving each of said chin pads inwardly and outwardly relative to said respective side pad and for selectively moving each of said chin pads forwardly and rearwardly relative to said respective side pad; and means for selectively simultaneously moving said side pads, and said chin pads and said positioning means carried respectively thereby, inwardly so as to engage the opposing sides of the head and chin and grip the head and chin therebetween.

2. The invention defined in claim 1 wherein each of said side pads is mounted on a respective movable cross member having a toothed portion formed thereon, and said means for simultaneously moving said pads includes a rotatable gear engaged with both of said toothed portions, whereby rotation of said rotatable gear causes simultaneous movement of said cross members and said pads.

3. The invention defined in claim 2 wherein said means for simultaneously moving said pads further includes a shaft attached to said rotatable gear for rotation therewith and a control arm attached to said shaft for rotation therewith, whereby rotation of said control arm causes rotation of said rotatable gear.

4. The invention defined in claim 3 further including means for maintaining said pads at a predetermined spaced apart distance.

5. The invention defined in claim 4 wherein said means for maintaining said pads at a predetermined spaced apart distance includes a locking pin connected to said control arm and a non-rotatable gear, said locking pin being selectively movable into engagement with the teeth of said non-rotatable gear to lock said control arm in a desired position to maintain said pads at a predetermined spaced apart distance.

6. The invention defined in claim 5 wherein said non-rotatable gear is disposed about said rotatable shaft but is not secured thereto for rotation.

7. The invention defined in claim 5 further including means for normally urging said locking pin into engagement with said non-rotatable gear.

8. The invention defined in claim 7 wherein said means for normally urging said locking pin includes a shaft connected to said locking pin, an enclosure attached to said control arm for slidably enclosing said locking pin and said shaft, and a spring disposed about said shaft between said locking pin and one end of said enclosure for normally urging said locking pin outwardly of the other end of said enclosure into engagement with said non-rotatable gear.

9. The invention defined in claim 8 further including means for selectively moving said locking pin out of engagement with said non-rotatable gear.

10. The invention defined in claim 9 wherein said means for moving said locking pin includes a trigger arm attached at one end to said shaft and pivotally secured near the center thereof to said control arm, whereby movement of the other end of said trigger arm causes said locking pin to move inwardly of said enclosure and out of engagement with said non-rotatable gear.

11. The invention defined in claim 1 further including means for adjusting the position of each of said chin pads relative to the respective side pad.

12. The invention defined in claim 11 wherein said chin pads are slidably movable with respect to said side pads and said adjusting means includes a threaded fastener and a pair of cooperating threaded nuts for securing said chin pads in a desired position relative to said side pads.

13. An apparatus for gripping a head for use with a neck exercising machine comprising:

a pair of opposed side pads adapted to be selectively moved inwardly toward one another into engagement with the opposing sides of the head;

a chin pad carried by each of said side pads and moveable inwardly therewith for engaging the opposing sides of the chin of the head;

positioning means connected between each of said side pads and said respective chin pad carried thereby for selectively moving each of said chin pads inwardly and outwardly relative to said respective side pad and for selectively moving each of said chin pads forwardly and rearwardly relative to said respective side pad;

means connected to both of said side pads for selectively simultaneously moving said side pads, and said chin pads and said positioning means carried respectively thereby, inwardly into engagement with the opposing sides of the head and chin so as to grip the head therebetween; and means for connecting said moving means to the neck exercising machine.

14. The invention defined in claim 13 wherein each of said side pads is mounted on a respective movable cross member having a toothed portion formed thereon, and said means for simultaneously moving said pads includes a rotatable gear engaged with both of said toothed portions, whereby rotation of said rotatable gear causes simultaneous movement of said cross members and said pads.

15. The invention defined in claim 14 wherein said means for simultaneously moving said pads further includes a shaft attached to said rotatable gear for rotation therewith and a control arm attached to said shaft for rotation therewith, whereby rotation of said control arm causes rotation of said rotatable gear.

16. The invention defined in claim 15 further including means for maintaining said pads at a predetermined spaced apart distance.

17. The invention defined in claim 16 wherein said means for maintaining said pads at a predetermined spaced apart distance includes a locking pin connected to said control arm and a non-rotatable gear, said locking pin being selectively movable into engagement with the teeth of said non-rotatable gear to lock said control arm in a desired position to maintain said pads at a predetermined spaced apart distance.

18. The invention defined in claim 17 wherein said non-rotatable gear is disposed about said rotatable shaft but is not secured thereto for rotation.

19. The invention defined in claim 17 further including means for normally urging said locking pin into engagement with said non-rotatable gear.

20. The invention defined in claim 19 wherein said means for normally urging said locking pin includes a shaft connected to said locking pin, an enclosure attached to said control arm for slidably enclosing said locking pin and said shaft, and a spring disposed about said shaft between said locking pin and one end of said enclosure for normally urging said locking pin outwardly of the other end of said enclosure into engagement with said non-rotatable gear.

21. The invention defined in claim 20 further including means for selectively moving said locking pin out of engagement with said non-rotatable gear.

22. The invention defined in claim 21 wherein said means for moving said locking pin includes a trigger arm attached at one end to said shaft and pivotally secured near the center thereof to said control arm, whereby movement of the other end of said trigger arm causes said locking pin to move inwardly of said enclosure and out of enggement with said non-rotatable gear.

23. The invention defined in claim 13 further including means for adjusting the position of each of said chin pads relative to the respective side pad.

24. The invention defined in claim 23 wherein said chin pads are slidably movable with respect to said side pads and said adjusting means includes a threaded fastener and a pair of cooperating threaded nuts for securing said chin pads in a desired position relative to said side pads.

25. The invention defined in claim 13 further including means for selectively moving said chin pads inwardly and outwardly relative to said side pads in order to more firmly engage the enclosed head.

26. The invention defined in claim 25 wherein said adjusting means includes a threaded fastener.

27. An apparatus for gripping a head for use with a neck exercising machine comprising:

a pair of opposed side pads adapted to be selectively moved inwardly toward one another into engagement with the opposing sides of the head;

a stationary top pad adapted to engage the top of the head;

respective cross members attached to each of said side pads extending upwardly therefrom and across the top of said top pad, each of said cross members including a toothed portion above said top pad;

a rotatable gear adapted to simultaneously engage both of said toothed portions of said cross members;

a shaft secured to said rotatable gear for rotation therewith, said shaft being journalled for rotation at one end in said top pad and at an opposite end through a central strut secured above said top pad;

a non-rotatable gear secured to said central strut, said non-rotatable gear being disposed about said shaft but not secured thereto for rotation;

a control arm attached to said shaft for rotation therewith, said control arm including means for selectively engaging said non-rotatable gear to maintain said control arm in a predetermined position;

means for connecting said central strut to the neck exercising machine;

a chin pad carried by each of said side pads and moveable inwardly therewith for engaging the opposing sides of the chin of the head; and positioning means connected between each of said side pads and said respective chin pad carried thereby for selectively moving each of said chin pads inwardly and outwardly relative to said respective side pad and for selectively moving each of said chin pads forwardly and rearwardly relative to said respective side pad.

* * * * *